US008733438B2

(12) United States Patent
Kenison et al.

(10) Patent No.: US 8,733,438 B2
(45) Date of Patent: May 27, 2014

(54) SYSTEM AND METHOD FOR OBTAINING LOAD MEASUREMENTS IN A WELLBORE

(75) Inventors: Michael H. Kenison, Richmond, TX (US); Richard Morrison, Sugar Land, TX (US); Robert Van Kuijk, Le Plessis Robinson (FR); Jose Vidal Noya, Marly Le Roi (FR); Carlos Foinquinos Bocco, Katy, TX (US); Robin Mallalieu, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 428 days.

(21) Appl. No.: 12/113,437

(22) Filed: May 1, 2008

(65) Prior Publication Data

US 2009/0071645 A1 Mar. 19, 2009

Related U.S. Application Data

(60) Provisional application No. 60/973,211, filed on Sep. 18, 2007.

(51) Int. Cl.
*E21B 47/00* (2012.01)

(52) U.S. Cl.
USPC ..... 166/250.01; 166/66; 73/152.59

(58) Field of Classification Search
USPC ..... 166/250.01, 66; 73/152.48, 152.49, 73/152.59, 862.622, 862.623
See application file for complete search history.

(56) References Cited

U.S. PATENT DOCUMENTS

| | | | | | |
|---|---|---|---|---|---|
| 3,022,822 | A | * | 2/1962 | Loy et al. | 166/250.01 |
| 3,402,601 | A | * | 9/1968 | Heineman | 73/862.392 |
| 3,855,857 | A | * | 12/1974 | Claycomb | 73/152.59 |
| 3,864,968 | A | * | 2/1975 | Anderson | 73/152.59 |
| 3,968,473 | A | * | 7/1976 | Patton et al. | 367/83 |
| 4,120,198 | A | * | 10/1978 | Tanguy et al. | 73/152.48 |
| 4,269,063 | A | * | 5/1981 | Escaron et al. | 73/152.59 |
| 4,294,318 | A | * | 10/1981 | Desbrandes et al. | 175/321 |
| 4,359,898 | A | * | 11/1982 | Tanguy et al. | 73/152.48 |
| 4,479,564 | A | * | 10/1984 | Tanguy | 181/105 |
| 4,515,011 | A | * | 5/1985 | Beimgraben | 73/152.48 |
| 4,608,861 | A | * | 9/1986 | Wachtler et al. | 73/152.48 |
| 4,805,449 | A | * | 2/1989 | Das | 73/152.48 |
| 4,811,597 | A | * | 3/1989 | Hebel | 73/152.48 |
| 4,946,190 | A | | 8/1990 | Buttner | |
| 4,958,517 | A | * | 9/1990 | Maron | 73/152.48 |
| 5,386,724 | A | * | 2/1995 | Das et al. | 73/152.59 |
| 6,009,216 | A | * | 12/1999 | Pruett et al. | 385/12 |

(Continued)

FOREIGN PATENT DOCUMENTS

| | | | |
|---|---|---|---|
| EA | 200601070 | A1 | 10/2006 |
| RU | 2208153 | C2 | 7/2003 |

(Continued)

*Primary Examiner* — William P Neuder
*Assistant Examiner* — Robert E Fuller
(74) *Attorney, Agent, or Firm* — Michael Flynn; Robin Nava; Timothy Curington

(57) ABSTRACT

A technique for determining conditions downhole in a well, particularly load conditions acting on a well tool, e.g. a bottom hole assembly. The loads acting on a bottom hole assembly or other well tool during a well related operation are measured. Load data is collected and may be transmitted uphole in real time for evaluation at a surface control unit. Based on the load data and other possible data related to the downhole operation, corrective actions can be taken to improve the operation.

28 Claims, 6 Drawing Sheets

(56) References Cited

U.S. PATENT DOCUMENTS

| | | | | |
|---|---|---|---|---|
| 6,233,524 | B1 * | 5/2001 | Harrell et al. | 702/9 |
| 6,296,066 | B1 * | 10/2001 | Terry et al. | 175/92 |
| 6,547,016 | B2 * | 4/2003 | Wassell | 175/45 |
| 6,662,110 | B1 | 12/2003 | Bargach et al. | |
| 6,662,645 | B2 * | 12/2003 | Brewer | 73/152.48 |
| 6,684,949 | B1 * | 2/2004 | Gabler et al. | 166/250.01 |
| 6,957,575 | B2 * | 10/2005 | Boucher et al. | 73/152.48 |
| 7,165,612 | B2 | 1/2007 | McLaughlin | |
| 7,420,475 | B2 * | 9/2008 | Adnan et al. | 340/853.3 |
| 7,591,314 | B2 * | 9/2009 | Sonnier et al. | 166/301 |
| 2004/0045351 | A1 * | 3/2004 | Skinner | 73/152.48 |
| 2005/0263281 | A1 * | 12/2005 | Lovell et al. | 166/255.1 |
| 2006/0044156 | A1 | 3/2006 | Adnan et al. | |
| 2006/0070734 | A1 * | 4/2006 | Zillinger et al. | 166/255.1 |

FOREIGN PATENT DOCUMENTS

| | | | |
|---|---|---|---|
| RU | 58174 | U1 | 11/2006 |
| SU | 1675546 | A1 | 9/1991 |
| WO | 2006071591 | A2 | 7/2006 |
| WO | 2006071670 | A2 | 7/2006 |

* cited by examiner

SYSTEM AND METHOD FOR OBTAINING LOAD MEASUREMENTS IN A WELLBORE

CROSS-REFERENCE TO RELATED APPLICATION

The present document is based on and claims priority under 35 USC 119(e) to U.S. Provisional Application Ser. No. 60/973,211, filed Sep. 18, 2007.

BACKGROUND

A variety of hardware is used downhole to accomplish many types of well related operations. The hardware, e.g. well tool, often is delivered downhole as part of a tool string used to perform the desired operation. For example, well tools can be delivered downhole to perform drilling operations, treatment operations, tool actuation operations, measurement operations, fishing operations and other well related operations. During use downhole, the hardware can be subjected to a variety of loads, including compression loads, tension loads, torsion loads, shock loads, and vibration loads. If the loading becomes excessive, damage can be incurred by the downhole hardware.

Attempts have been made to detect and measure loading that occurs in a downhole environment. For example, downhole sensor packages with local data storage have been used to measure loads experienced by a downhole tool string during coiled tubing operations. The locally stored data is then retrieved for post job analysis. However, the delayed access to data limits the usefulness of the system with respect to making adjustments to reduce detrimental loading during the well related operation. There is no capability for optimizing performance through real time control. Other attempts have been made to send load data to the surface, but available systems have tended to be limited in data transfer capacity and accuracy. Other drawbacks associated with existing systems include relatively large outside diameters that restrict the usefulness of such systems in a variety of downhole operations.

SUMMARY

In general, the present invention provides a system and method for determining conditions at a well tool used in a downhole well related operation. The system and method comprise measuring loading on the well tool during a well related operation at a downhole position. Load data may be transmitted uphole for evaluation at a surface control unit. Although some applications may use locally stored data, other applications benefit from the transmission of some or all data uphole in real time. Based on the downhole operational data obtained, corrective actions can be taken to improve the operation.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method for detecting, measuring, and managing loads incurred by downhole equipment during various well related operations. The load data can be obtained in real time to facilitate a greater understanding of those loads and to enhance the ability to take corrective action. For example, the load data obtained downhole can be transmitted to a surface control unit for analysis and determination of appropriate corrective action. The data also can be used to synchronize the operational equipment downhole with the surface control unit. In some applications, responses to the load data can be automated via the surface control unit so that appropriate corrective actions are automatically taken to improve the well operation.

The system and methodology described herein can be used to detect and measure a variety of load forces to which a well tool may be subjected during a downhole operation. For example, load forces related to vibration forces, compressive forces, tensile forces, torque forces, shock forces and other types of load related forces can be detected, measured and transmitted uphole in real time. Depending on the downhole operation, other well related parameters also can be measured, and data on those parameters can be transmitted to the surface control unit. By way of example, some of these other parameters may include trajectory, reach, friction, drilling speed, motion, pressure, temperature and other parameters that can affect specific downhole operations.

Figure 1:
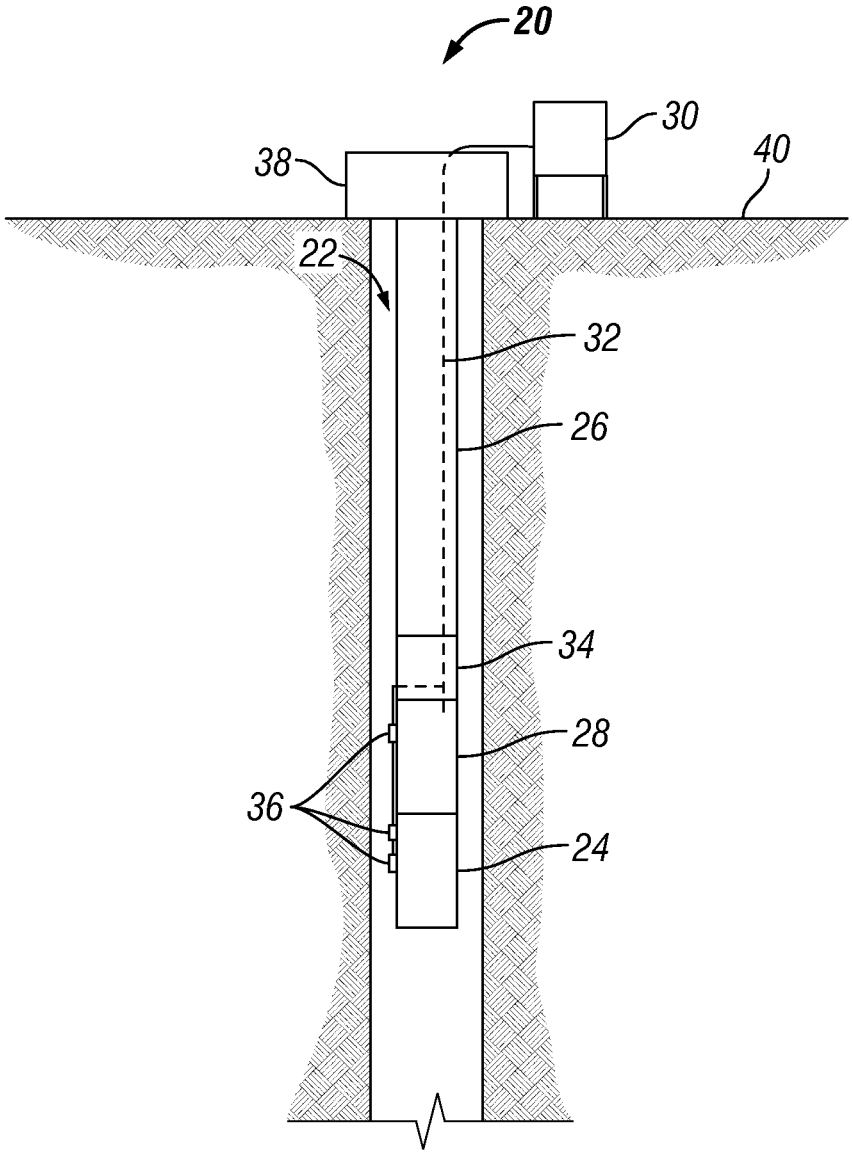
FIG. 1 is a schematic front elevation view of a well system that can obtain and utilize load data, according to an embodiment of the present invention.

Referring generally to FIG. 1, one embodiment of a system 20 is illustrated as deployed in a wellbore 22. The system 20 is representative of a variety of well systems used in carrying out many types of well related operations, as explained in greater detail below. Additionally, system 20 is designed to detect, measure and transmit load related data from a downhole location to, for example, a surface location for analysis and use in improving the specific well operation being performed. In the application illustrated, the system is designed to transmit this load data in real time to enable immediate corrective action during the downhole operation. Additional parameter related data also can be detected, measured and transmitted in real time to facilitate the analysis.

In the example illustrated, system 20 comprises a well tool 24 that may be deployed to a desired location in wellbore 22 via a conveyance 26, such as a coiled tubing conveyance, drill string, jointed pipe, or other conveyance. Well tool 24 is engaged with a load detection sub assembly 28 designed to detect one or more types of loading that can be incurred by well tool 24. Sub assembly 28 sends load related data uphole to a surface control unit 30, such as a computer-based control unit. The data is sent uphole via a communication line 32, such as a fiber optic line. In the embodiment illustrated, load detection sub assembly 28 is connected to conveyance 26 via a connector assembly 34 which may be a "smart" connector assembly able to convert data from sub assembly 28 to a suitable format for transmission along a fiber optic communication line. Suitable electronics for transmitting data uphole in real time can be located in connector assembly 34, sub assembly 28, a combination of the two assemblies, or at other suitable locations along the tool string.

Load detection sub assembly 28 can be designed to detect one or more of a variety of load forces, e.g. compressive loads, tensile loads, torque loads, shock loads and other loads to which well tool 24 is susceptible. Additionally, a variety of sensors 36 also can be deployed downhole to detect and measure other well related parameters. Data on the additional parameters also can be sent uphole to surface control unit 30 via communication line 32 or via other suitable communication lines, including hard wired and wireless communication lines. By way of example, sensors 36 may comprise accelerometers, inclinometers, gamma ray sensors, gyros, pressure sensors, casing collar locators, and temperature sensors.

In many applications, the use of one or more fiber optic communication lines 32 greatly facilitates the real time transfer of data from load detection sub assembly 28 and potentially other sensors 36. Fiber optic communication lines 32 also can be combined with the conveyance 26, e.g. coiled tubing conveyance 26, and deployed, for example, along the interior of the coiled tubing or within a wall of the coiled tubing. In a specific example, the fiber optic communication line 32 and coiled tubing conveyance 26 have been combined and are commercially available from Schlumberger Corporation. In one embodiment, coiled tubing 26, fiber optic communication line 32 and connector assembly 34 are combined as a fiber optic telemetry platform available from Schlumberger Corporation. The platform can be used to sense a variety of wellbore parameters, e.g. temperature, annular pressure, applied pressure, and data on those parameters is transmitted to surface control unit 30 via fiber optic communication line 32. In this embodiment, the load detection sub assembly 28 can be mounted to the bottom of the measurement platform as a modular extension.

The measurement platform generally comprises coiled tubing with a fiber optic tether deployed along an interior of the coiled tubing. The fiber optic tether has one or more optical fibers located inside a protective tube which may be formed of a metallic material or other material having suitable properties. The coiled tubing and the fiber optic tether have suitable upper and lower terminations or connections that allow fluid to be introduced into the coiled tubing and directed along the interior of the coiled tubing. However, different arrangements of optical fibers can be deployed in a variety of ways along coiled tubing, production tubing or other appropriate conveyances.

In the example illustrated, system 20 is deployed in a generally vertical wellbore that extends downwardly from a wellhead 38 positioned at a surface location 40. However, system 20 and its load detection capabilities can be utilized in a variety of wells, including horizontal wells and other types of deviated wells. The system 20 also can be used in many types of environments and applications, including land based applications and subsea applications. The type of well tool or tools 24 used in cooperation with load detection sub assembly 28 may vary substantially depending on downhole operation. The illustrated well tool 24 is representative of a variety of well tools that are run downhole to perform one or more selected, well related operations.

For example, well tool 24 may comprise a bottom hole assembly used in a milling operation. In this example, the bottom hole assembly comprises a bit driven by a motor that operates via pressure applied with fluid flowing through conveyance 26 which is in the form of a tubing. The load detection sub assembly 28 can be used to detect load changes indicative of bit stalling. Stalling causes the overall rate of penetration to decrease because the operator must lift off and reposition the bit to begin milling again. Stalling also reduces bit life as well as the life of the motor and the coiled tubing. The sub assembly 28 is able to provide torque data experienced by the bottom hole assembly 24 in real time, and this torque loading is useful as an indicator of imminent stalling. The information enables early corrective action to prevent stalling and thereby increase the overall rate of penetration and improve component life. In this embodiment, sensors 36 can be used to provide additional information. For example, sensors 36 may comprise a gyro to indicate orientation, a gamma ray sensor to indicate depth correlation, an inclinometer to track orientation, and an accelerometer to detect shock and/or inclination. The accelerometer can be provided as a separate sensor or as part of the load detection sub assembly 28.

In another application, well tool 24 comprises a bottom hole assembly, and load detection sub assembly 28 is used to measure loads associated with setting inflatable or mechanical packers. In deviated wells, for example, the set down weight required to actuate a packer is difficult to determine with surface measurements alone. The sub assembly 28 can be used to monitor and output data on the set down force actually being applied downhole. Tensile loads also can be measured and output to provide an indication as to how much force can be applied during removal of the bottom hole assembly. By providing this data in real time, disconnect forces can be avoided. Similarly, by monitoring the downhole loads, it is possible to prevent an overload situation that might damage the tool.

Similarly the load detection sub assembly 28 can be used to monitor and output load data when shifting sliding sleeves downhole. The sub assembly 28 provides information on set down weight or overpull applied to the sliding sleeve. Additionally, if the shifting tool does not disengage from the sleeve, precise load information can be provided in real time regarding the force applied to break the shear screws as necessary for disengagement. In a fishing operation, the sub assembly 28 can provide similar load data related to forces applied to dislodge the "fish". Force load data can make the fishing operation faster, safer and more efficient.

In other applications, well tool 24 comprises a vibration tool that generates vibration downhole to reduce friction forces associated with moving the coiled tubing farther downhole. The performance of the vibration tool 24 can be monitored by sub assembly 28 and sensors 36 in real time to enable optimization of the operational parameters and thus enhance execution of the operation.

The well tool 24 also may comprise a tractor, and load detection sub assembly 28 can be used to measure loads incurred during tractoring operations. For example, it can be important to know whether the tractor is on or off and to also know the amount of force applied by the tractor while pulling the string. The sub assembly 28 is able to provide loading information in real time so that an operator has a more accurate understanding of the downhole operation of the tractor. The real time observation of loads also can prevent tool string failure and damage. Load data also can be used in combination with a variety of surface measurements and systems that enable optimal synchronization of tractor operation with coiled tubing unit surface controls to avoid overloads and to minimize failures.

In other applications, well tool 24 comprises a drilling tool, and sub assembly 28 can be used to provide load data similar to that described above with respect to the milling operation. For example, real time tracking of weight on the bit and torque applied to the drilling tool can be used to prevent stalls and to maximize rate of penetration.

The load detection sub assembly 28 also can be used in a variety of other operations. For example, the sub assembly can be used during perforating jobs to monitor loads induced as result of the perforating operation. In this application, the sub assembly 28 can be used to provide data indicative of how and whether the perforating guns have been activated. An integrated accelerometer also could be used to monitor shock, and a variety of other sensors can be used to provide data on various aspects of the perforating operation. The sub assembly 28 also can detect drag on the bottom hole assembly 24 and the coiled tubing string that results from excessive overloads of fill being lifted. Similarly, sub assembly 28 can be used to identify lock up situations, such as those that result from an obstruction rather than an inability to transmit loads to the bottom hole assembly.

Accordingly, the load detection sub assembly 28 provides a better understanding, in real time, of how the well tool 24 is being affected downhole by loading that results from a variety of forces, torques, vibrations and movements. This is particularly important in adverse scenarios when transmission of downhole loads is affected by well geometry, completions, fluids, and other downhole characteristics. The various measurements enable better operational analysis and improve the ability to take appropriate corrective action.

The sensors 36 and load detection sub assembly 28 also can be used in conjunction with a variety of other surface measurement and control systems. For example, systems are available that provide indications of coiled tubing weight or that prevent unplanned overloading situations. These additional systems can be operated by surface control unit 30 or in conjunction with surface control unit 30. In many applications, surface control unit 30 can be programmed to automatically take certain corrective actions based on preset parameters when specific data is provided by load detection sub assembly 28, sensors 36, and/or other cooperating measurement and control systems.

Figure 2:
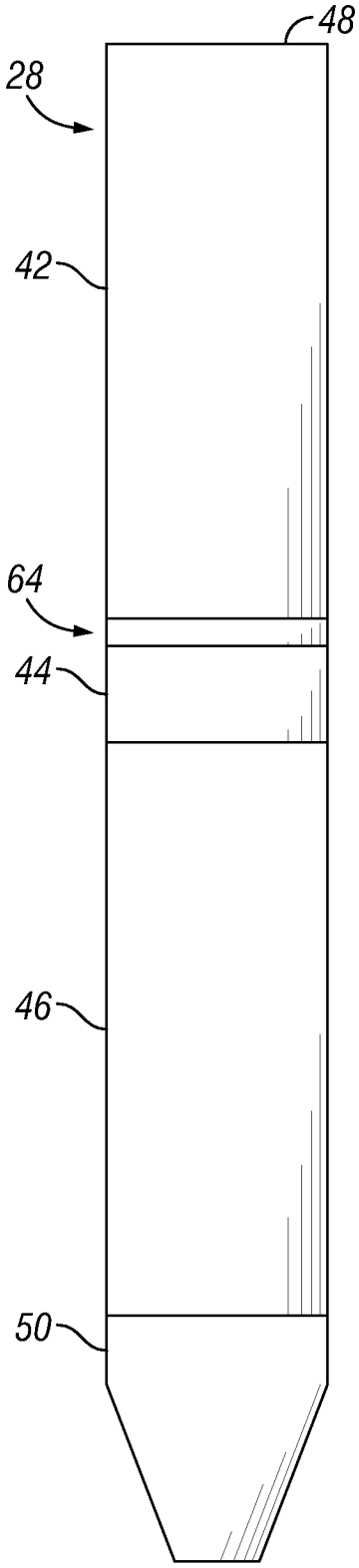
FIG. 2 is a front elevation view of a load detection assembly for use in the well system illustrated in FIG. 1, according to an embodiment of the present invention.

Depending on the type of well tool 24 and the type of operation in which well tool 24 is utilized, the shape, size and configuration of load detection sub assembly 28 can vary. However, one example of load detection sub assembly 28 is illustrated in FIG. 2. In this embodiment, sub assembly 28 comprises an upper housing 42, a load cell 44, and a load cell housing 46. Upper housing 42 comprises a connector end 48 opposite load cell 44 to enable connection of sub assembly 28 to connector assembly 34 via, for example, threaded engagement or another suitable engagement mechanism. At an opposite end, sub assembly 28 comprises a connector 50 that may be any of a variety of connectors depending on the well tool 24 to which it is connected for a specific well related operation.

Figure 3:
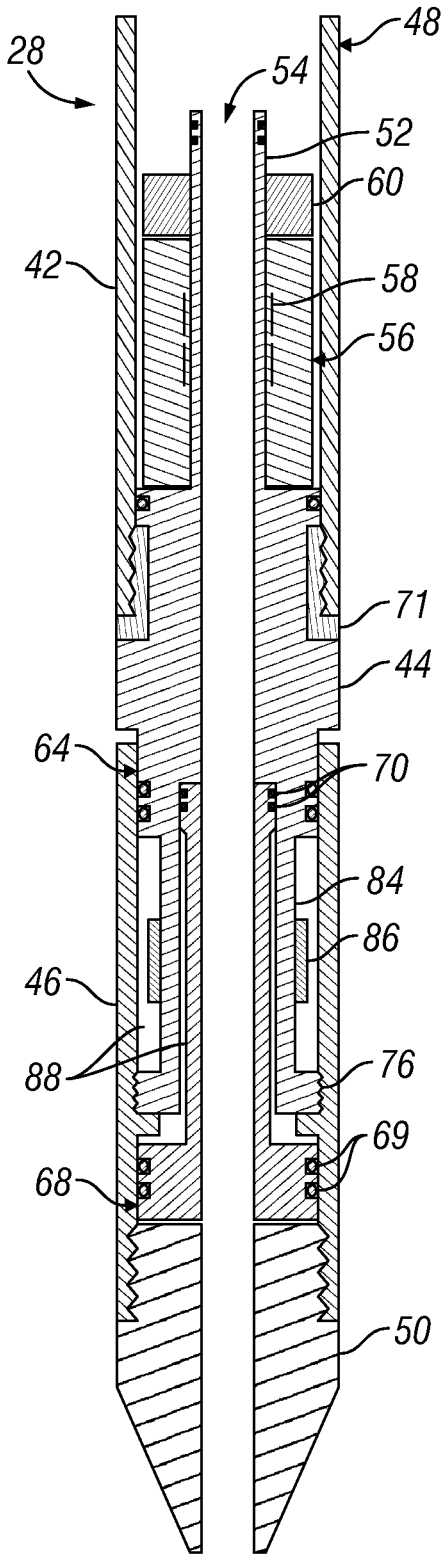
FIG. 3 is a cross-sectional view taken generally along the axis of the load detection assembly illustrated in FIG. 2, according to an embodiment of the present invention.
Figure 4:
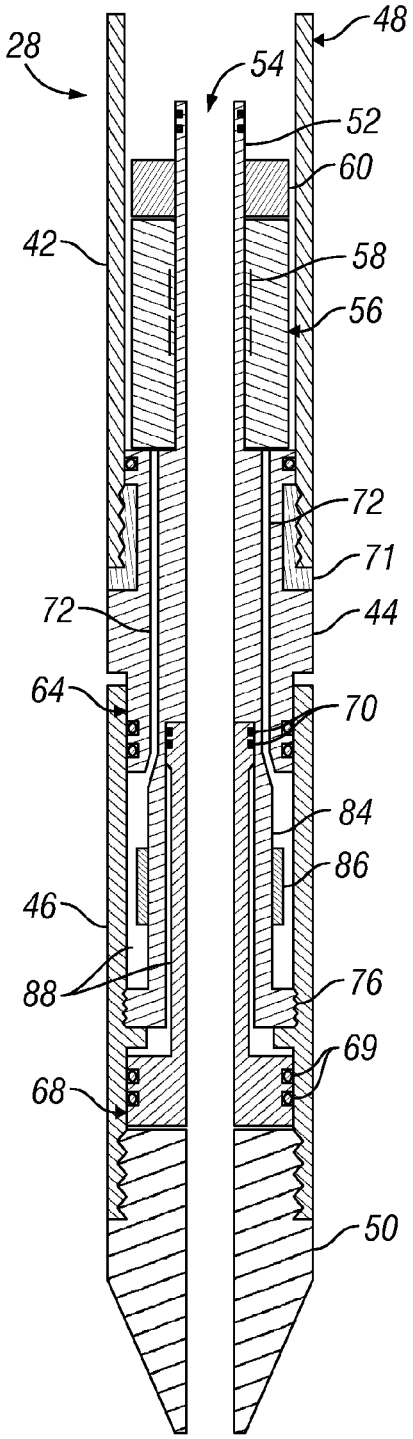
FIG. 4 is a cross-sectional view similar to that of FIG. 3 but showing slightly different features, according to an embodiment of the present invention.

Referring generally to FIGS. 3 and 4, cross-sectional views are provided of the sub assembly embodiment illustrated in FIG. 2. As illustrated, sub assembly 28 comprises a tubular member 52 extending from load cell 44 and partially defining a flow passage 54 formed through sub assembly 28 to accommodate fluid flow through sub assembly 28. Additionally, sub assembly 28 comprises electronics 56 that may be mounted on a circuit board 58 for processing signals received from load cell 44. Circuit board 58 may be mounted between tubular member 52 and upper housing 42, as illustrated. Signals are transmitted from electronics assembly 56 to a communication line connector 60 which is designed for engagement with a corresponding connector in connector assembly 34, thus enabling transmission of signals to the surface.

Sub assembly 28 comprises a chassis 64 that is disposed within upper housing 42 in a manner that does not obstruct flow passage 54. Tubular member 52 may be formed as an integral part of chassis 64. Also, chassis 64 is rigidly connected to or integrated with load cell 44, as illustrated in FIG. 3. A pressure balancing seal structure 68 is installed at the lower or downhole end of load cell housing 46 and a seal is formed between seal structure 68 and the load cell housing 46 via a seal element 69. Seal structure 68 extends up into an interior of chassis 64 and forms a seal with chassis 64 via a seal element 70, as illustrated. In the embodiment illustrated, seal structure 68 is formed as a pressure compensating piston.

Sub assembly connections, such as the connection of the upper housing 42 with load cell 44 can be formed with split connectors 71 which allow the connection of components without requiring relative rotation of the electrical connections. With respect to electrical connections, wiring may be routed from connector assembly 34 and connector end 48 down along the outside diameter of chassis 64. By way of example, the wiring may be terminated on the uphole side of circuit board 58. From the downhole end of circuit board 58, the wiring is further routed along or through chassis 64 and integrated load cell 44. The wiring is brought to the outside diameter of the load cell 44 via one or more ports 72, illustrated best in FIG. 4. Routing the wiring to the radially outward side of load cell 44/chassis 64 allows the wiring to be appropriately connected to the load cell. For example, the wiring may be connected to load measurement sensors, e.g. strain gauges or other load measurement sensors, of the load cell 44.

The wiring route and the arrangement of components in load detection sub assembly 28 enable the detection and monitoring of loads without having the load measurements skewed by extraneous elements. For example, the load measurements are isolated from the effects of radial and hoop forces caused by the pressure of fluid pumped along flow passage 54 and from similar effects due to pressure that is external to the tool. The load measurements also are isolated from axial forces induced by hydrostatic pressure in the wellbore. Accordingly, more accurate measurements of load forces, e.g. compressive and tensile load forces, are made possible, as illustrated in FIGS. 5 and 6.

Figure 5:
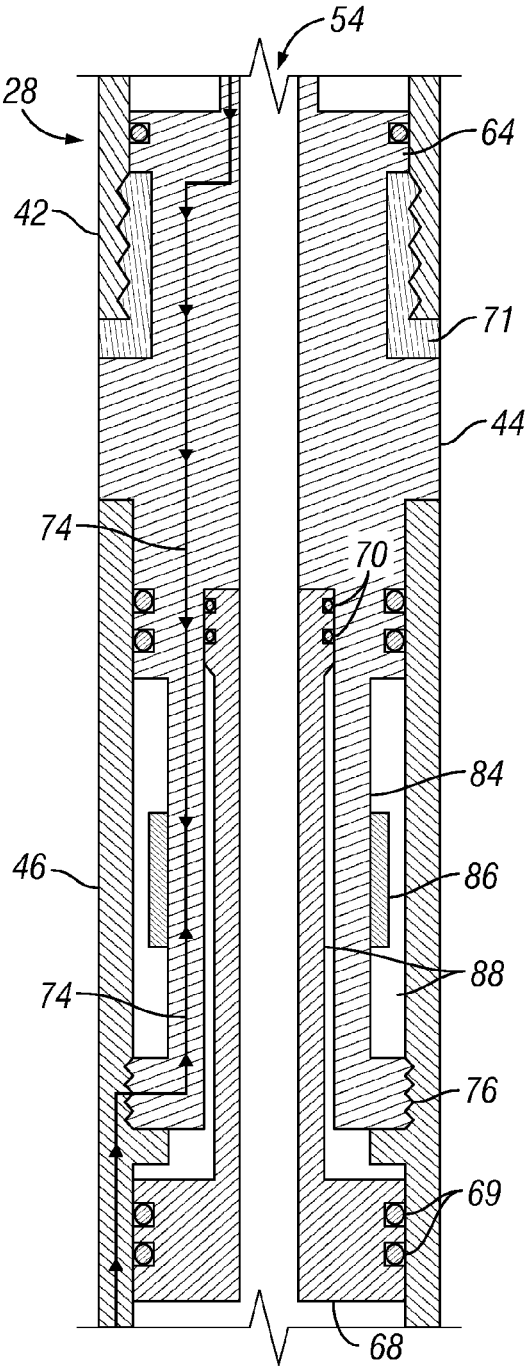
FIG. 5 is a cross-sectional view of a portion of the load detection assembly illustrating a compressive load path, according to an embodiment of the present invention.

Referring to FIG. 5, a compressive load path 74 is illustrated. The compressive load path 74 results from placement of sub assembly 28 under compressive loading and illustrates the components of sub assembly 28 that carry the load forces to load cell 44. From the downhole end of the sub assembly 28, the loading force is exerted through load cell housing 46 and transferred to chassis 64 and the load cell 44 via a threaded region 76. The compressive load force travels through load cell 44 and chassis 64.

Figure 6:
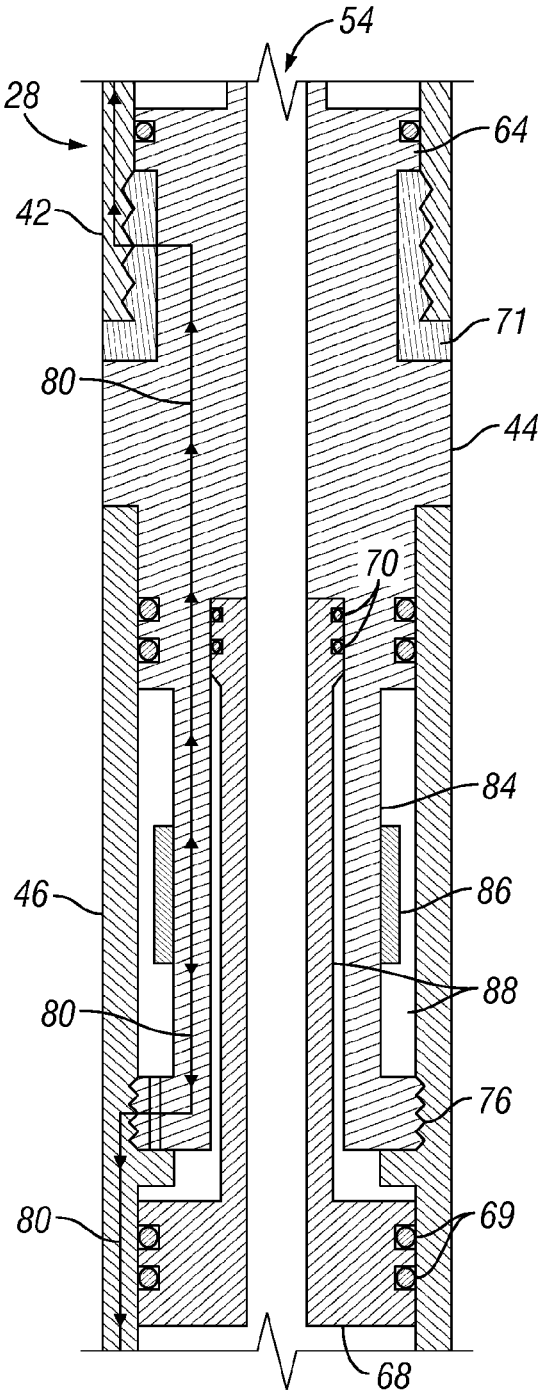
FIG. 6 is a cross-sectional view of a portion of the load detection assembly illustrating a tensile load path, according to an embodiment of the present invention.

In FIG. 6, a tensile load path 80 is illustrated. The tensile load path 80 results from placement of sub assembly 28 under tensile loading and illustrates the components of sub assembly 28 that carry the tensile load forces to load cell 44. From the downhole end of the sub assembly 28, the tensile loading force is carried through load cell housing 46 and transferred to chassis 64 and load cell 44 via threaded region 76. The tensile load force travels up through load cell 44 and is transferred to the shouldered split ring connector 71. Split ring connector 71 transfers the tensile loading to upper housing 42 and upward through the tool string.

Figure 7:
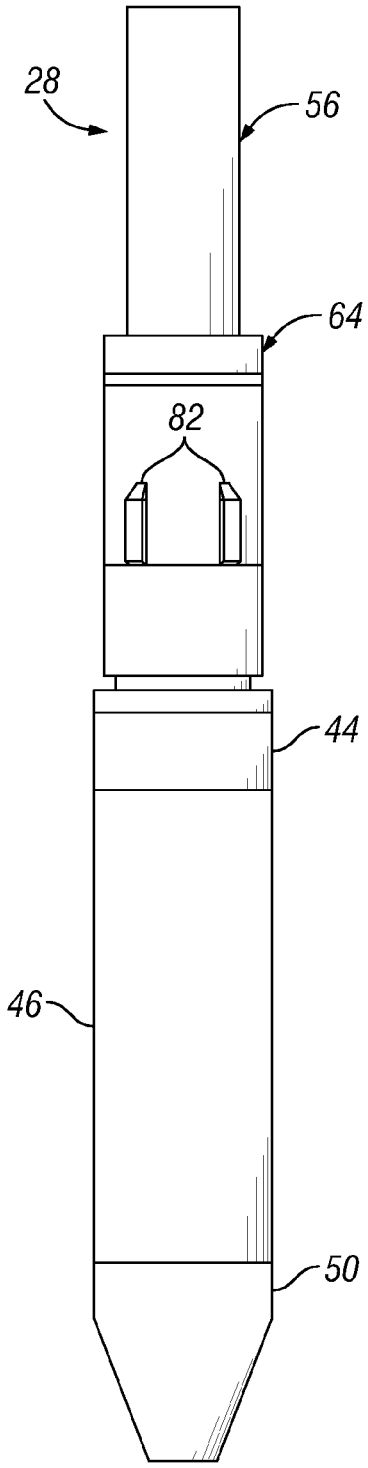
FIG. 7 is a front elevation view of the load detection assembly with a portion of the assembly removed to illustrate torque keys, according to an embodiment of the present invention.

Under torque loading, the torque loads can be transferred between upper housing 42 and load cell 44 via one or more torque keys 82, as illustrated in FIG. 7. The torque keys 82 are engaged between load cell 44 and upper housing 42 such that any twisting loads acting on conveyance 26 are transmitted to load cell 44 via upper housing 42 and torque keys 82.

The arrangement of components in system 20 and load detection sub assembly 28 facilitates the provision of accurate and immediate information that can be used to avoid failures and to optimize the downhole operation. For example, real time data can be communicated to surface control unit 30 via, for example, fiber optic telemetry. The fiber optic telemetry and arrangement of sub assembly 28 enable transmission of data while the downhole operation is underway, including while fluids are pumped through flow passage 54. The design not only enables mechanical pressure compensation and radial temperature compensation but also eliminates the effect of "make-up force" on the strain gauge area of the load cell 44.

By way of further explanation, the sub assembly 28 is designed to compensate both for the radial and hoop forces that are caused by the pressure of fluid as it is pumped along flow passage 54, as well as for similar effects caused by pressure external to the tool. Additionally, the sub assembly 28 is designed to compensate for axial forces induced by hydrostatic pressure in wellbore 22. Compensation for these extraneous pressure/forces is achieved in part by the design of load cell 44 which has a load sensor mounting area 84 for receiving one or more load measurement sensors 86, e.g. strain gauges, optical load sensors, or other load sensors, as illustrated in FIG. 8.

The portion of the outside diameter of load cell 44 where the load measurement sensor 86 is mounted in and surrounded by a sealed atmospheric chamber 88. Chamber 88 is sealed by a seal element 90 cooperating with seal elements 69 and 70. Additionally, the chassis 64 which forms tubular member 52 and flow passage 54 is sealed downhole relative to the load sensor mounting area 84 by pressure balancing piston/seal structure 68. Extra radial clearance can be added between the outside diameter of chassis 64 and the inside diameter of the load sensor mounting area 84 of load cell 44 to ensure contact does not occur due to pressure induced or thermally induced expansion of chassis 64. Thus, the inside diameter of load cell 44 is only affected by atmospheric pressure in the chamber 88.

Figure 8:
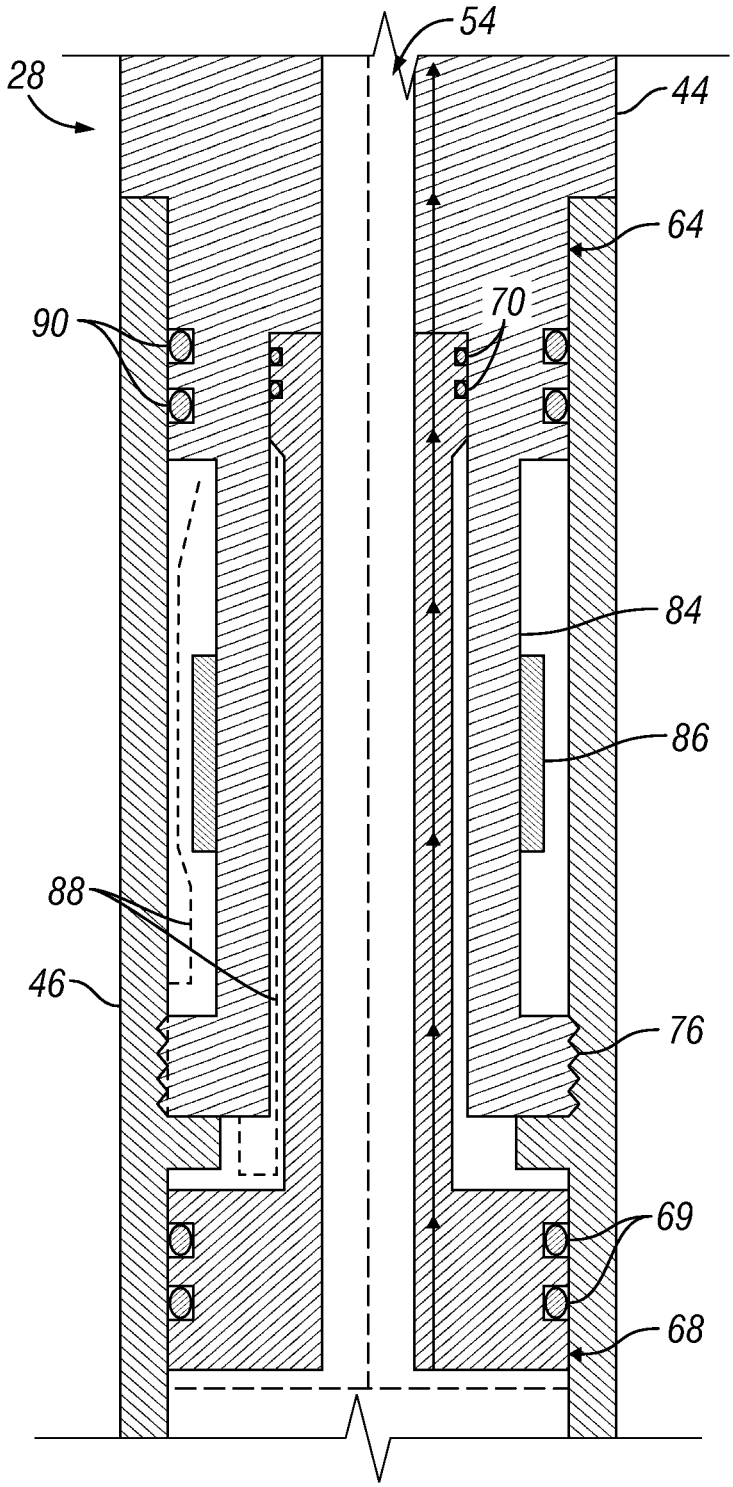
FIG. 8 is a cross-sectional view of a portion of the load detection assembly illustrating a strain gauge mounting area, according to an embodiment of the present invention.

Furthermore, the sealed area against which hydrostatic pressure can act extends from the outside diameter of pressure balancing seal structure 68, in the region where it seals against the inside diameter of load cell housing 46 via seal element 69, to the outside diameter of seal structure 68, where it seals against the inside diameter of load cell 44/chassis 64 via seal element 70, as illustrated in FIG. 8. In the axial direction, seal structure 68 enables the compression caused by the hydrostatic pressure to bypass load sensor mounting area 84. This effect is due to the outermost sealing diameter being the same on either side of the atmospheric chamber 88. As a result, force is transferred to seal structure 68 which acts as a compensating piston. With respect to radial temperature differences, the atmospheric conditions surrounding load sensor mounting area 84 along both the outside and inside of load cell 44 negate any radial temperature differences in the section of load cell 44 containing strain gauges 86.

With certain types of bottom hole assemblies, such as bottom hole assemblies that shoulder internally, the sub assembly chassis can be subjected to substantial compressive make-up forces during interactions downhole. However, when sub assembly 28 is "made-up" at its upper end, chassis 64 shoulders internally which causes compressive forces in the load cell 44 from the split connector ring 71 along its length in the uphole direction and in the chassis 64 from its connection with the load cell 44 along its length in the uphole direction. The load sensor mounting area 84 is not subjected to these make-up forces. Additionally, when the downhole end of sub assembly 28 is "made-up", compression is only experienced by load cell 44 from the threaded region 76 of load cell housing 46 to the location where the load cell housing 46 shoulders against the load cell, as illustrated in FIG. 8. Accordingly, the load sensor mounting area 84 is not affected by the make-up forces.

Figure 9:
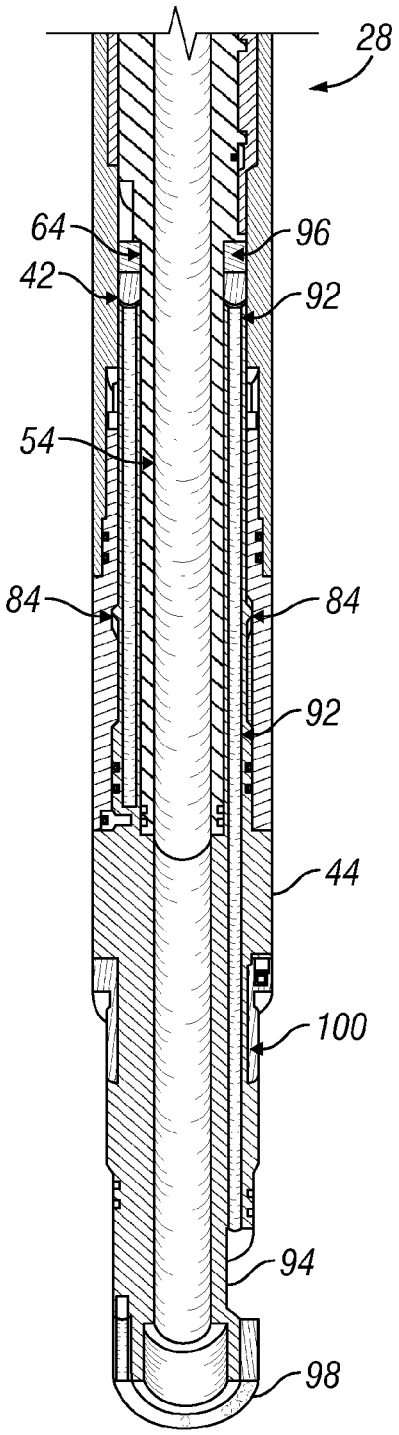
FIG. 9 is a cross-sectional view of an alternate load detection assembly, according to an alternate embodiment of the present invention.

In FIG. 9, an alternate embodiment of sub assembly 28 is illustrated. In this embodiment, the load detection sub assembly 28 comprises a passage 92 for receiving a downhole tool bus 94, e.g. wires or cable, to provide communication and/or power to a desired device located below the sub assembly 28. Many of the components in this embodiment are the same as those described above with reference to FIGS. 1-8, however passage 92 extends from an upper connector block 96 to a lower connector block 98. The tool bus, e.g. wires, is connected between circuit board 58 and connector block 96. From connector block 96, the wires are passed through the passage 92 that extends through load cell 44 until reaching lower connector block 98. To avoid rotating connections, a split ring connector 100 can be mounted proximate a lower end of the sub assembly 28.

Figure 10:
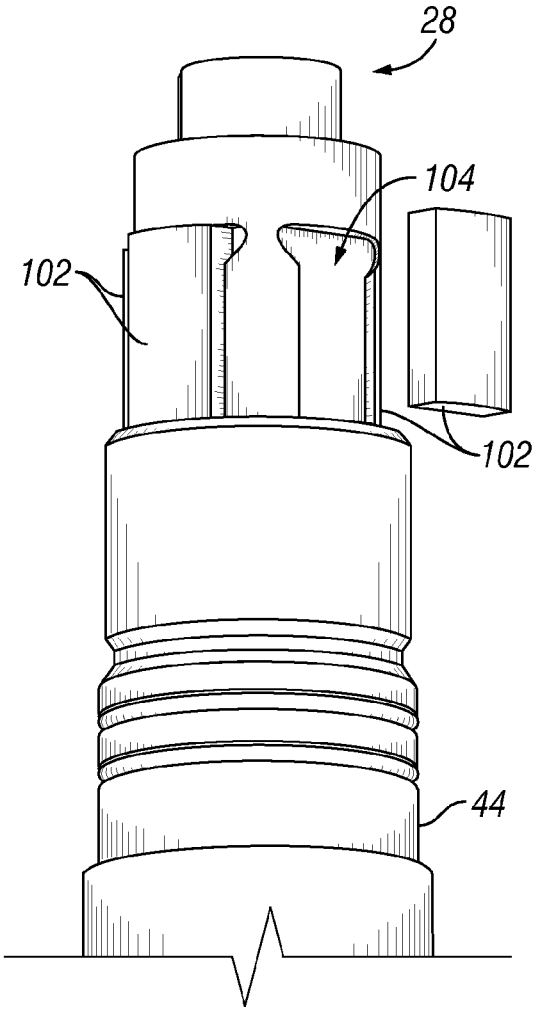
FIG. 10 is an illustration of one example of keys that can be used to transfer torque loads if non-rotating tool connections are used, according to an alternate embodiment of the present invention.

Tension and torsion are transmitted via a plurality of loading keys 102, as illustrated in FIG. 10. The loading keys 102 are installed in corresponding slots 104 formed in a portion of load cell 44. When the alternate sub assembly 28 is exposed to compressive loads, the loads are transferred directly from load cell 44 to chassis 64, as described above. However, under tensile loading, the loads are transferred to upper housing 42 via loading keys 102, and chassis 64 is bypassed. The loading keys are designed to fit snugly into slots 104 and corresponding slots of upper housing 42. As a result, torsion loads also are transferred from the load cell 44 to upper housing 42 while bypassing chassis 64. In this alternate embodiment, chassis 64 seals internally against load cell 44 downhole of the load sensors/strain gauges. This arrangement provides the same radial pressure and temperature compensation as described with respect to the previous embodiment. The effects of make-up forces on the load sensor mounting area 84 also are avoided in the same way as described with respect to the previous embodiment.

As described above, system 20 can be constructed in a variety of configurations for use in many environments and applications. The load detection sub assembly can be constructed to isolate a load sensor from extraneous loading internal to the sub assembly, external to the sub assembly, exerted axially, resulting from regular tool make-up, resulting from temperature and pressure effects and/or other extraneous loads. Additionally, the size and arrangement of the load detection sub assembly can be adjusted for environmental and operational factors. The types of load sensors and sensors incorporated into the load detection sub assembly, as well as the additional sensors utilized in conjunction with the sub assembly, can vary substantially depending on the desired operations and the desired parameters to be monitored. The electronics can be substituted with optical systems that rely an optical sensors. Additionally, the surface control unit 30 may combine a variety of systems and may be programmed in many different ways to facilitate monitoring, analysis, and the taking of corrective actions either automatically or with the assistance of an operator.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A method of facilitating a downhole operation, comprising:

measuring loading at a downhole position in a wellbore during a downhole operation, wherein measuring loading comprises measuring a compressive load, a tensile load, a torque load, and/or a shock load with a sub attached to a bottom hole assembly, the sub having a housing defining a flow passage therethrough for accomodating fluid flow through the sub, a seal structure formed as a pressure compensating piston, and a load cell disposed and sealed in an atmospheric chamber, and wherein the housing and the pressure compensating piston cooperate to isolate the load cell from undesirable loading effects;

transmitting load data uphole in real-time via telemetry via an optical fiber deployed along a tubular conveyance;

evaluating the load data at a surface control unit; and making a corrective action downhole based on the load data;

wherein the pressure compensating piston is not in direct fluid communication with an annulus of the wellbore external to the housing.

2. The method as recited in claim 1, wherein measuring loading comprises measuring loads acting on a bottom hole assembly during a milling operation.

3. The method as recited in claim 1, wherein measuring loading comprises measuring loads during the setting of a packer.

4. The method as recited in claim 1, wherein measuring loading comprises measuring loads during actuation of a downhole tool.

5. The method as recited in claim 1, wherein measuring loading comprises measuring loads during a fishing operation.

6. The method as recited in claim 1, wherein measuring loading comprises measuring loads to ensure excess detrimental loading is not incurred at a given downhole tool.

7. The method as recited in claim 1, wherein measuring loading comprises measuring loads during a perforating operation.

8. A method, comprising:

detecting loading of downhole equipment in a wellbore during a coiled tubing operation, wherein detecting comprises utilizing a load sub assembly having a housing, a seal structure formed as a pressure compensating piston, a load cell and a flow passage for accommodating fluid flow from the coiled tubing and through the load sub assembly, wherein the load cell is disposed in and surrounded by a sealed atmospheric chamber and isolated from undesirable loading effects that are both internal and external to the load sub assembly, wherein the pressure compensating piston is not in direct fluid communication with an annulus of the wellbore external to the housing; and using telemetry to transmit load data to a surface control unit in real-time by transmitting load data via optical fiber deployed within a fiber optic tether within the coiled tubing.

9. The method as recited in claim 8, wherein detecting loading comprises detecting compressive forces acting on a downhole equipment.

10. The method as recited in claim 8, wherein detecting loading comprises detecting tensile forces acting on the downhole equipment.

11. The method as recited in claim 8, wherein detecting loading comprises detecting torque acting on the downhole equipment.

12. The method as recited in claim 8, wherein detecting loading comprises detecting shock forces acting on the downhole equipment.

13. The method as recited in claim 8, further comprising utilizing additional sensors to detect other desired downhole parameters; and transmitting additional sensor data to the surface control unit in real-time.

14. The method as recited in claim 13, wherein utilizing comprises detecting vibration and inclination.

15. The method as recited in claim 8, wherein detecting comprises utilizing the load sub assembly attached to a bottom hole assembly.

16. The method as recited in claim 8, wherein the coiled tubing operation comprises at least one of a drilling operation, a treatment operation, a tool actuation operation, a measurement operation, and a fishing operation.

17. The method as recited in claim 8, wherein the internal loading effects comprise at least loading effects from the flow of fluid through the load sub assembly.

18. A system for detecting loads downhole, comprising:

a coiled tubing assembly comprising at least a load sub assembly having a substantially unobstructed flow through passage for treatment fluid downstream of the load sub assembly, the load sub assembly comprising:

a housing;

a pressure compensating piston; and a load cell, wherein the load cell comprises a load sensor mounted in a sealed atmospheric chamber and wherein the housing and the pressure compensating piston cooperate to isolate the load cell from undesirable loading effects, wherein the loading effects comprise at least loading effects from the flow of fluid through the load sub assembly, wherein the pressure compensating piston is not in direct fluid communication with an annulus of the wellbore external to the housing.

19. The system as recited in claim 18, wherein the load cell is isolated from undesirable loading effects internal to the load sub assembly, the internal loading effects comprising at least the loading effects from the flow of fluid therethrough.

20. The system as recited in claim 18, wherein the load cell is isolated from undesirable loading effects external to the load sub assembly.

21. The system as recited in claim 18, wherein the load cell is isolated from undesirable loading effects that are both internal and external to the load sub assembly.

22. The system as recited in claim 18, wherein the load sub assembly further comprises an electronic assembly constructed to relay load data uphole in real-time via fiber optic telemetry.

23. The system as recited in claim 18, wherein the load sub assembly further comprises a plurality of keys positioned to transfer loading to the housing from the load cell.

24. The system as recited in claim 18, wherein the load cell is isolated from the effects of radial and hoop forces caused by the pressure of fluid being pumped along the flow through passage and from axial forces induced by hydrostatic pressure in the wellbore.

25. The system as recited in claim 18, wherein the load cell is isolated from the effects of undesirable axial forces.

26. The system as recited in claim 18, wherein the load cell is isolated from the effects of undesirable load forces resulting during regular tool make-up.

27. The system as recited in claim 18, wherein the coiled tubing assembly comprises optical fiber to carry data from the load sub assembly to a surface control unit.

28. The system as recited in claim 18, further comprising a downhole tool bus for providing communication and/or power to a device below the sub assembly.

* * * * *